US006855423B2

(12) United States Patent
Fidan et al.

(10) Patent No.: US 6,855,423 B2
(45) Date of Patent: Feb. 15, 2005

(54) WRAPPED CORD

(75) Inventors: Mehmet Sadettin Fidan, Garbsen (DE); Charles Edward Forbes, Edgewater, NJ (US); Chad D. Fisher, Concord, NC (US); Stephan Fredrick Sherriff, Salisbury, NC (US); Andreas Topp, Hannover (DE)

(73) Assignees: Continental AG, Hanover (DE); Arteva Technologies, S.A.R.L., Zurich (CH)

( * ) Notice: Subject to any disclaimer, the term of this patent is extended or adjusted under 35 U.S.C. 154(b) by 0 days.

(21) Appl. No.: 10/372,527

(22) Filed: Feb. 21, 2003

(65) Prior Publication Data

US 2003/0129399 A1 Jul. 10, 2003

Related U.S. Application Data

(63) Continuation of application No. 09/766,244, filed on Jan. 19, 2001, now abandoned.

(51) Int. Cl.[7] ..... D02G 3/36; D02G 3/00

(52) U.S. Cl. ..... 428/375; 428/373; 428/377; 428/378; 428/395; 57/3; 57/6; 57/210; 152/451; 152/359

(58) Field of Search ..... 428/373, 375, 428/377, 378, 395; 57/210, 6, 3; 152/451, 359

(56) References Cited

U.S. PATENT DOCUMENTS 3,625,809 A * 12/1971 Caroselli et al. ..... 428/222
3,634,972 A * 1/1972 Illman ..... 57/202
3,682,202 A * 8/1972 Buhrmann et al. ..... 138/126
3,956,566 A * 5/1976 van Gils et al. ..... 428/375
3,964,950 A 6/1976 Boles
3,968,304 A 7/1976 Wise
3,991,027 A 11/1976 van Gils
4,009,134 A 2/1977 Elmer
4,015,651 A 4/1977 Witt et al. ..... 152/356
4,026,744 A 5/1977 Elmer
4,052,501 A * 10/1977 Kreahling et al. ..... 264/137
4,134,869 A 1/1979 Kalafus
4,176,705 A 12/1979 Russell et al. ..... 152/359
4,251,409 A 2/1981 Neubert
4,299,884 A 11/1981 Payen
4,343,343 A * 8/1982 Reuter ..... 152/556
4,409,055 A 10/1983 Elmer
5,017,451 A * 5/1991 Larson et al. ..... 430/137.19
5,215,613 A 6/1993 Shemenski et al. ..... 156/136
5,845,476 A * 12/1998 Kolmes ..... 57/229
6,065,518 A 5/2000 Miyawaki et al. ..... 152/454
6,102,823 A 8/2000 Hosokawa et al. ..... 474/242
6,539,698 B2 4/2003 Fidan

OTHER PUBLICATIONS

Three Pages providing definitions relevant to this Application from "Glossary of Terms" from *Engineering Plastics,* vol. 2, Engineered Materials Handbook, ASM International.

* cited by examiner

*Primary Examiner*—Rena Dye
*Assistant Examiner*—Camie S Thompson
(74) *Attorney, Agent, or Firm*—John S. Child, Jr.

(57) ABSTRACT

The present invention relates to a wrapped cord, to a method of making said wrapped cord, to a method of treating said wrapped cord with an adhesive treatment composition, to the treated wrapped cord obtainable by said method as well as to a reinforced rubber article comprising said treated cord, such as automotive tires.

34 Claims, 3 Drawing Sheets

WRAPPED CORD

CROSS REFERENCE TO RELATED APPLICATIONS

This application is a continuation of U.S. patent application Ser. No. 09/766,244, filed Jan. 19, 2001 now abandoned, and claims the benefit of that prior application under 35 U.S.C. § 120.

The present invention relates to a wrapped cord, to a method of making said wrapped cord, to a method of treating said wrapped cord with a treatment composition and to the treated wrapped cord obtainable by said method as well as to a reinforced rubber article comprising said treated cord, such as automotive tires.

BACKGROUND OF THE INVENTION

A tire is a highly engineered composite designed to provide safety and durability. Tires, in particular automotive tires for passenger cars or aircraft tires for aircrafts, undergo significant dynamic and static stresses and strains in the course of ordinary service life. Performance is critical in this product application due to ramifications of failure while in use. In order to obtain the necessary performance characteristics critical to the proper functioning of a tire, structural reinforcement is a required component of the tire composite. This reinforcement provides many functions in a tire application, in particular overall strength, dimensional stability for the tire and a mechanism to handle stress dissipation during operation (fatigue).

Currently, there is a well established set of products/processes to provide the reinforcing material used in passenger car and truck tire applications.

1. High strength yarn is spun and drawn to produce a continuous filament with engineered physical properties, most notably strength, modulus and shrinkage with different linear densities. High modulus, low shrinkage (HMLS) polyester and rayon are the organic fibers of choice, with HMLS polyester being preferred as carcass reinforcement in passenger car tires.
2. This yarn is then twisted, and multiple twisted ends are plied together to form a cord structure. Twist is imparted to the yarn and cord in order to provide the required fatigue resistance for the reinforcement material in the tire, especially in the sidewall and turn-up region. While the twisting results in improved fatigue performance, it lowers the overall strength and modulus of the cord structure. This twist can be imparted by a) twisting the single yarns in one operation and then plying the twisted single ends into a cord in an other operation, or, b) twisting and plying in the same step by using direct cabling operations.
3. In most applications, these cords are then woven into a fabric where the cords form the warp direction and a higher elongation material is used in the weft-direction to create a stable fabric that will be used as the tire reinforcement. Less frequently, the cords are not woven into a fabric and proceed to the next step in cord form.
4. The woven fabric (or cord) is then introduced into a chemical/thermal process where a) adhesives are applied to the fabric that promote adhesion of the reinforcement to the rubber compound used in tire manufacture, and b) the fabric is exposed to high temperatures to cure the adhesives and set the final shrinkage, modulus and strength characteristics of the fabric/cord. The fabric (or cord) can then be introduced to the tire manufacturing process where it is combined with rubber to from a rubberized fabric/cord that will constitute the reinforcement component of the tire.

The step(s) that involve(s) twisting and plying is a critical operation in this series of processes. In this step, the proper construction and amount of twist must be established in order to obtain the proper fatigue resistance; however, this must be balanced against the loss in strength and modulus that occurs with twisting/plying as well as the costs for imparting twist, which increase with increasing twist levels. Much effort has been put into developing the proper twist levels to minimize cost and meet key durability requirements.

It has been shown that the twist imparted to the cord structure allows the cord to uniformly dissipate strain during compressive forces, the predominant forces (with respect to fatigue failure) that occur in service. The twist allows the cord to move out of plane during compression, thus avoiding catastrophic failure.

However, the conventional twisted cords suffer from modulus and breaking strength losses due to their helical constructions while having improved flex and compression fatigue resistance. The losses increase with increasing twist-level or helix-angle.

SUMMARY OF THE INVENTION

It has been an object of the present invention to provide a mechanism for strain dissipation and therefore fatigue resistance that does not require the conventional state-of-the-art twisting/cabling operations. In particular it has been an object of the present invention to provide a cord that combines the original yarn properties (a high breaking strength and, preferably, a high modulus) with an improved fatigue resistance.

Additionally, it has been an object of the present invention to provide a method for making said improved cord.

A further object of the present invention was to provide a such improved cord being treated with a treatment agent that promotes adhesion (adhesive agent) to rubber and possessing the final shrinkage characteristics, said treated cord being ready to be introduced into the true manufacturing process where it is combined with rubber. Finally it has been an object of the present invention to provide a reinforced rubber article comprising the treated cord of the invention in the form of said cord itself or a fabric comprising said cord as a reinforcement.

It has been found that the above and further objects can be achieved by wrapping a low-denier, high shrinkage organic fiber (yarn) around a core bundle of filaments (yarns) resulting in a cord that resists fatigue while maintaining bundle coherency. The cord of the invention provides a mechanism for strain dissipation and therefore fatigue resistance, that does not require the twisting/cabling operations. The wrap material is wrapped in a helical pattern around the core, where wrap frequency and wrap angle can be specified based on performance requirements.

This cord structure according to the present invention has advantages over the conventional cord that is twisted and plied in that the elimination of twisting/cabling operations saves costs and, because the core HMLS fiber is not twisted, there is no strength-loss of the core bundle in the cord. This allows fabric constructions to be modified to utilize less material to achieve the same strength and therefore reduces cost. In summary, the wrapped cord according to the present invention provides a cost-reduction for the formation of tire cord reinforcement and increased modulus while maintaining the necessary performance characteristics.

DETAILED DESCRIPTION OF THE INVENTION

Figure 1:
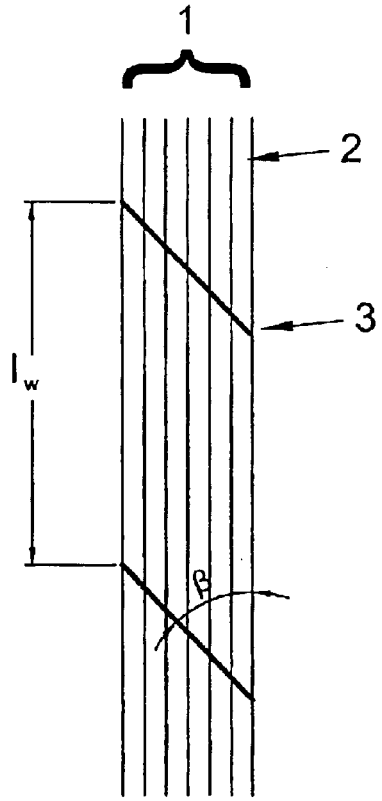
FIG. 1 shows a wrapped cord 1 according to the invention comprising a core bundle of filaments 2 and a shrinkable wrap 3 wrapped around the core bundle of filaments 2 and wherein "$I_w$" represents the inter-wrap distance ($I_w$=1/wpm) and "β" the wrap-angle, i.e., the angle between the bundle-axis and the wrap.
Figure 2:
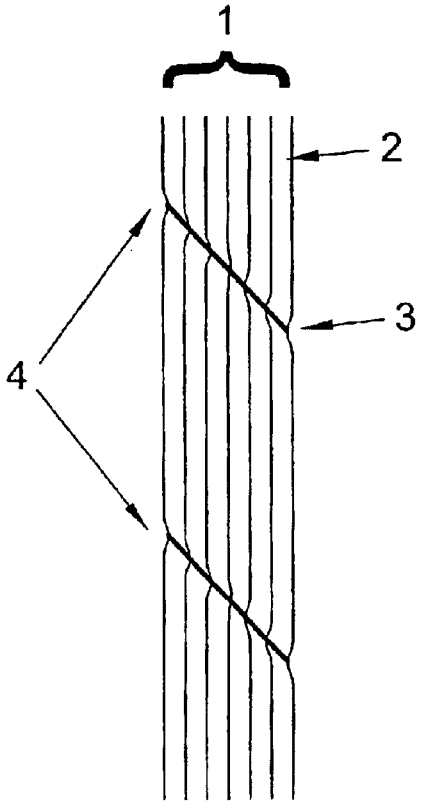
FIG. 2 shows a wrapped cord 1 according to the invention comprising a core bundle of filaments 2 and a shrunk wrap 3 wrapped around the core bundle of filaments 2 wherein the indentations 4 are formed due to the shrunk wrap (wrap-induced indentations).
Figure 3:
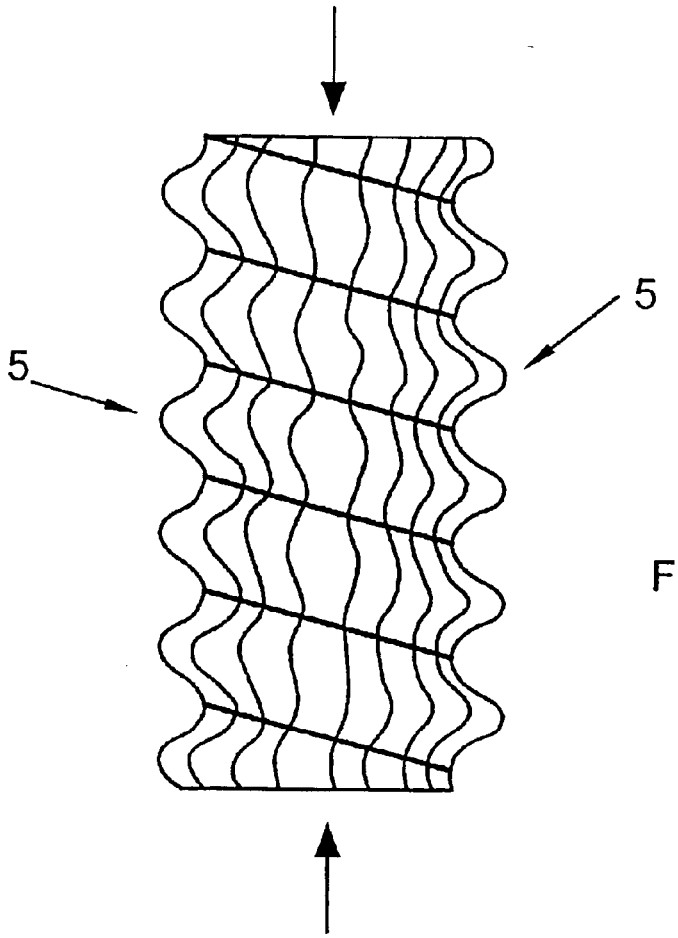
FIG. 3 shows the wrapped cord 1 according to the invention under compression wherein buckles 5 are formed between the wrap.
Figure 4:
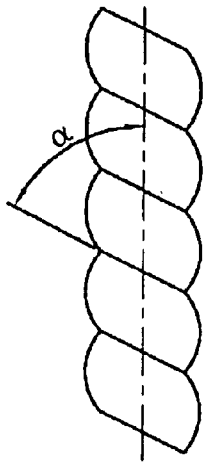
FIG. 4 shows a conventional, state-of-the-art twisted cord comprising yarn plies 6 being twisted at a helix-angle "α"
Figure 5:
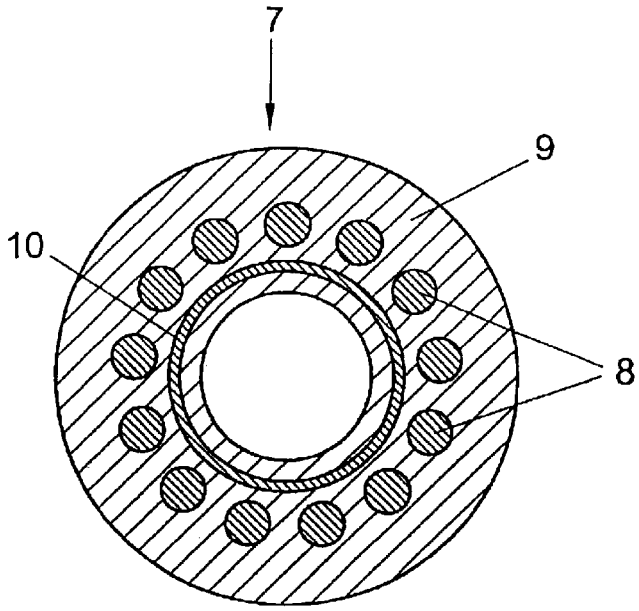
FIG. 5 shows the cross-section of a rubber tube 7 comprising the cords 8 embedded in rubber 9 and to be tested for failure in the Mallory tube fatigue tester shown in FIG. 6. Reference numeral 10 represents a spirally wound reinforcement yarn (e.g., rayon).
Figure 6:
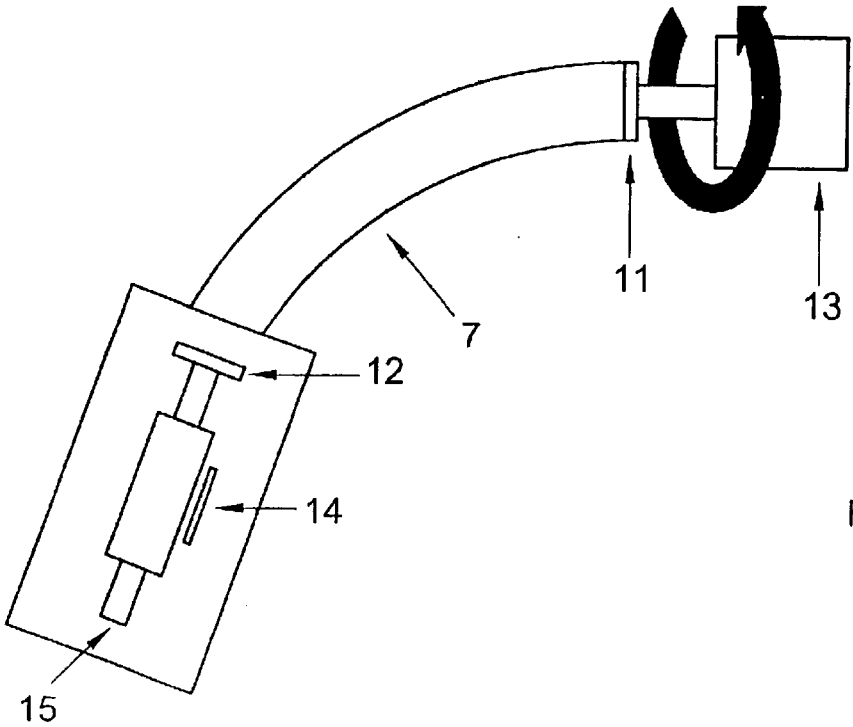
FIG. 6 shows the Mallory tube fatigue tester for testing the tube test specimen 7 positioned at a 75° angle between the two clamps 11 and 12. 13 is a rotary drive in rotary union with device 14. Inlet 15 is connected to a regulated pressure air-supply (not shown).

In conjunction with the present invention the meaning of the following terms is defined as follows:

A filament is a continuous fiber usually made by extrusion from a spinneret and which can be converted into a yarn.

A yarn is represented by a number of fibers twisted together or laid together without a twist (zero-twist yarn).

A cord is the product formed by twisting together two or more plied yarns.

The present invention relates to a wrapped cord comprising as its core a bundle of filaments and a wrap helically wound around the bundle of filaments wherein the wrap material has a free shrinkage at 100° C. being at least about 10% higher than the free shrinkage of the core material.

In another embodiment, said free shrinkage (without pretension) of the wrap material is at least about 20%, in a still further embodiment at least about 30% higher than the material of the core filaments in order to have an effective squeezing effect on the core bundle of filaments upon shrinkage.

The filaments of the core material are made of a thermally low-shrinkable high tenacity material. Although not a key-factor in one embodiment the the modulus of the core filaments can range from low to high moduli and is from about 30 to about 500 cN/dtex (measured according to ASTM D 885-85; 120% strain, 25.0 m gauges, 2 twists per 2.54 cm (one inch) at 0.5% elongation), in another embodiment said modulus is from about 60 to about 250 cN/dtex. The thermal shrinkability (shrinkage conditions: 177° C. with 0.1 cN/dtex; exposure time 2 minutes) of the core filaments is from about 0.0 to about 5.0% (measured according to ASTM D 4974-93), in another embodiment from about 1.0 to about 3.0% and in a still further embodiment less than 2.0%, measured after heat setting the filaments.

The tenacity of the filaments making up the core bundle of filaments is from about 5.0 to about 15 cN/dtex (measured according to ASTM D885), in another embodiment from about 6.0 to about 10 cN/dtex and in a still further embodiment from about 6.5 to about 70 cN/dtex.

The dtex of the individual core filaments is from about 1.0 to about 10.0 dtex (measured according to ASTM D885 M), in another embodiment from about 2.0 to about 5.0 dtex and in a still further embodiment from about 3.0 to about 4.0 dtex.

The core bundle of the wrapped cord according to the invention comprises from about 200 to about 2000, in another embodiment from about 400 to about 1800 and in a still further embodiment from about 500 to about 1000 filaments.

In the wrapped cord according to the invention the core bundle of filaments is not twisted (zero-twist) or, alternatively, twisted at a frequency of up to about 200 twists, alternatively up to about 100 twists per meter (tpm) of the bundle. The core bundle of filaments has a twist level from 0.0 to 200 tpm in Z direction for a 2200 dtex polyester yarn. The upper twist level for different dtex and polymer types can be calculated for different dtex and polymer types can be calculated on basis of the following formula $$tpm_{(polymer)}=[(200\times\sqrt{2200}/\sqrt{dtex_{(polymer)}})\times(\sqrt{\rho_{(polymer)}}/\sqrt{\rho_{PET}})]$$

wherein tpm represents turns per meter, dtex is total bundle dtex, and ρ represents the specific density of the filament polymer ($\rho_{PET}$: 1.39 g/cm$^3$).

In another embodiment, the number of twists per meter of bundle, is from about 20 to about 40. Due to their untwisted or low twisted bundle they give the reinforcement high breaking-strength and modulus.

In general any organic material known as having a utility as reinforcing fiber and having the above described physical properties is suitable as the material of the core filaments. Suitable materials for these filaments are selected from the group consisting of polyesters, such as aliphatic and aromatic polyesters, polyamides, such as aliphatic polyamides and aromatic polyamides (polyaramides) and rayons (regenerated cellulose and cellulose esters). In one alternative the polyesters are selected from polyethyleneterephthalate, polyethylenenaphthalate, polyethylenebibenzoate, polytriethylenetereph-thalate, polytrimethylenenaphthalate, polytrimethylenebibenzoate, poly-butyleneterephthalate, polybutylenenaphthalate and polybutylenebibenzoate or polyesters made from mixtures of the individual monomers.

Typical polyamides are selected from the group consisting of linear aliphatic polyamides (Nylons). Typical examples are Polyamide (PA) 6, PA 6.6 and PA 4.6.

Polyaramides (aromatic polyamides) are formed from aromatic diamines with aromatic dicarboxylic acids. Typical commercially available polyaramides are sold under the trade names Nomex®, Kevlar®, Twaron® and Kermel®.

The preferred low shrinkage core filaments are known in the art and commercially available, such as rayon DSP, polyester, etc. Typical materials are available under the tradename D792, T748, D240, D793 from KoSa, USA, 1×53 from Honeywell, Cordenka from Accordis, etc.

The filament(s) of the wrap have/has a hot air shrinkability at 100° C. (shrinkage without pretension) of from about 10 to about 60%, in another embodiment from about 20 to about 40%, and in a still further embodiment from about 25 to about 35%, i.e., remarkably higher than the filaments of the core.

The filament(s) of the wrap has/have a modulus of from about 20.0 to about 150.0 cN/dtex (as measured according to ASTM D885M), in another embodiment from about 30.0 to about 100.0 cN/dtex and in a still further embodiment from about 30.0 to 50.0 cN/dtex. Typically, the tenacity of said filament is from about 2.0 to about 12.0 cN/dtex, or from about 4.0 to about 8.0 cN/dtex or, in an alternative embodiment, from about 5.0 to 7.0 cN/dtex.

The wrap frequency (the number of wrap turns per meter of core bundle) of the wrap is from about 100 to 500 for a 2200 dtex PET core yarn, preferably between 200 and 400 and most preferably between 250 and 350 (in S direction).

The corresponding wrap ranges for other dtex's and polymer types can be calculated from the following formula $$WPM_{polymer}=[(WPM_{PET}\times\sqrt{2200})/\sqrt{dtex_{polymer}})\times(\sqrt{\rho_{polymer}}/\sqrt{1.4})]$$

Wherein WPM means wrap per meter, $WPM_{PET}$ means reference WPM for 2200 dtex polyester, $\rho_{polymer}$=specific density of new material and dtex polymer corresponds to the total bundle dtex of new material.

Any organic material having the above-described physical properties is suitable as the material of the wrap filaments or yarn. Suitable materials are selected from the group consisting of polyesters, such as aliphatic and aromatic polyesters, polyamides, such as aliphatic polyamides. In one embodiment the polyesters are selected from polyethyleneterephthalate, polyethylenenaphthalate, polyethylenebibenzoate, polytriethyleneterephthalate, polytrimethylenenaphthalate, polytrimethylenebibenzoate, poly-butyleneterephthalate, polybutylenenaphthalate and polybutylene-bibenzoate or polyesters made from mixtures of the individual monomers.

Typical polyamides are selected from the group consisting of linear aliphatic polyamides, such as PA 6, PA 6.6 and PA 4.6.

The fibers (filaments) with high amorph orientation are high shrinkage materials. Typical materials are available under the tradename "wire" (shrinkable yarn) from Wire and Rapos, U.S. (Ozeki Co., Japan).

General background information about the filaments mentioned above, their manufacture and properties can be found, for instance, in "Synthetische Fasern: Herstellung, Maschinen und Apparate, Eigenschaften; Handbuch für Anlagenplanung, Maschinenkonstruktionen und Betrieb" by F. Fourne, Carl Hanser Verlag, Germany, 1995.

The wrap dtex is from 5 to 40% of core-yarn dtex, preferably 5 to 30%, most preferably 10 to 20%.

Depending on the wrap frequency the wrap-angle β can vary from about 15° to about 45°, alternatively from about 20° to about 40° and, in a still further alternative, from about 25° to about 35°.

In a more specific embodiment the present invention relates to a wrapped cord comprising the above-described core-bundle of filaments and the wrap wherein the wrap is shrunk onto the core-bundle of filaments. In one embodiment the shrinkage of the wrap is effected by heat-treating the wrapped cord described below. Due to the shrinkage of the wrap, the indentations are formed in the core bundle. Under compression these indentations generate micro-buckles between the wraps which improves the fatigue-resistance. This leads to a uniform distribution of axial or bending compression.

The wrapped cord described above and comprising the heat-shrunk wrap can be made by forming the bundle of the core filaments, wrapping the wrap around said core bundle of filaments wherein the wrap material has a free shrinkage at 100° C. being a least about 10% higher than the free shrinkage of the core filament material and exposing said wrapped cord to an elevated temperature for a time sufficient to shrink the wrap onto the core bundle resulting in the wrapped cord according to the present invention in which the wrap is shrunk onto the core bundle.

Typically, in order to effect the heat-shrinkage of the wrap on the core filament bundle the wrapped cord is exposed to a temperature of from about 120° C. to 220° C., alternatively from about 170° C. to about 190° C. The exposure-time may vary from about 1 minute and 5 minutes or, alternatively, between about 2 and 4 minutes, depending on the wrap-material to be shrunk and the temperature employed.

Methods and devices (wrapping machines) for wrapping a core bundle of filaments with a filament or yarn are conventional and known in the art. Likewise, methods for the heat-treatment of untreated or treated yarns and cords are well known in the art.

Prior to the incorporation of the wrapped cord of the present invention into rubber as a reinforcement, the cord must be treated to impart an acceptable level of adhesion to the rubber which is necessary for composite performance.

Thus, the wrapped cord according to the present invention is treated with an aqueous agent, i.e., a dip comprising an adhesive composition. Subsequently said wrapped cord is dried, cured and heat-set.

As the fatigue resistance of the filament bundle is bending stiffness dependent a low pick-up of the adhesive composition is necessary. In one embodiment the treated cord according to the invention comprises, after drying the cord, from about 0.1 to about 2.0% by weight of the adhesive composition, based on the total weight of the treated wrapped cord. In another embodiment the treated dried cord comprises 0.2 to 1.0% by weight, in a yet other embodiment 0.5 to 0.8% by weight, based on the total weight of the treated and dried wrapped cord.

The dip pick-up (DPU) can be calculated based on the weight as follows:

$$DPU(\%)=[(\text{treated}-\text{greige})/(\text{greige})]\times 100.$$

In conjunction with the shrunk wrapped cord according to the present invention this low dip pick-up provides for an acceptable balance of level of adhesion, high breaking-strength, fatigue-resistance and low bending stiffness (flexibility).

Generally, any dip known in the art for improving and/or imparting adhesion of organic filaments, such as polyester and polyamide filaments to rubbers when forming cord-reinforced rubber composites can be utilized such as those disclosed in U.S. Pat. Nos. 3,956,566; 3,964,950; 3,968,304; 3,991,027; 4,009,134; 4,026,744; 4,134,869; 4,251,409 and 4,409,055 the entire disclosure of which is incorporated herein by reference. Known in the art examples for adhesive dips are RFL-based dips such as D5 for nylon and D20 for polyester which are commercially available under these designations from General Tire Corp., USA.

In one embodiment the adhesive composition is a mixture of resorcinol/formaldehyde resin and and elastomeric (rubber) latex, such as vinylpyridine butadiene styrene latex. This mixture is applied to the wrapped cord in the form of an aqueous dip comprising said adhesive composition. These dips are known in the art as "RFL"-dips. They are an aqueous mixture of a precondensate obtained by the reaction of resorcinol and formalin in the presence of an acidic or alkaline catalyst and one or more latexes selected from styrene-butadiene copolymer latex, carboxyl group containing styrene-butadiene copolymer latex, styrene-butadiene-vinylpyridine terpolymer latex, acrylonitrile-butadiene copolymer latex, polychloroprene latex, polybutadiene latex, natural rubber latex, and the like. The solids content of said RLF-dips ranges from about 1.0% to about 20%, alternatively from about 1.0% to about 5.0% by weight, based on the aqueous dip composition. Methods and devices for applying liquid treatment agents to fibers and yarns are known in the art.

Suitable RFL-dips which can be used in conjunction with the cords according to the present invention are known in the art. A typical RFL-dip, for example for PET, is represented by the following formulation:

| | |
|---|---|
| Water | 519.8 g |
| VP-Latex (40%) | 416.7 g |
| RF-Resin (75%) | 39.9 g |
| Ammonia (25%) | 11.2 g |
| Formaldehyde (37%) | 12.4 g |
| Total | 1000.0 g (20% solids content) |

The solids content can be reduced by diluting with water in order to provide for a low DPU on the wrapped cord. The method for making the treated wrapped cords of the present invention comprises the steps of (a) forming a core bundle of filaments;

(b) wrapping a wrap around said core bundle of filaments, wherein the wrap material has a free shrinkage at 100° C. being at least about 10% higher than the free shrinkage of the core filament material;

(c) exposing said wrapped cord to an elevated temperature to shrink the wrap;

(d) treating said wrapped cord with an aqueous agent comprising an adhesive composition; and (e) exposing said treated wrapped cord to an elevated temperature to effect drying, curing the adhesive and heat-setting of said treated wrapped cord.

In general, the elevated temperatures mentioned above for steps (c) and (e) may vary from about 110° C. to 220° C., depending on the wrap and core material and the adhesive composition employed. In one embodiment, the shrinkage step (c) may be carried out at a temperature of from about 120 to 220° C., in alternative embodiments as described above. The drying step (e) may be carried out at a temperature of 110 to 160° C., curing of the adhesive composition and heat-setting is carried out at a temperature of 150 to 220° C., preferably 170 to 210° C., most preferably 180 to 200° C.

In an alternative method for making the treated wrapped cord according to the present invention the method comprises the steps of (a) forming a core bundle of filaments;

(b) wrapping a wrap around said core bundle of filaments wherein the wrap material has a free shrinkage at 100° C. being at least about 10% higher than the free shrinkage of the core filament material;

(c) treating said wrapped cord with an aqueous agent comprising an adhesive composition; and (d) exposing said treated wrapped cord to an elevated temperature to effect shrinkage of the wrap, drying and curing of the adhesive and heat-setting of the core-filaments.

In this alternative, shrinking of the wrap is carried out at temperatures as defined above and drying the cord may be carried out at a temperature of about 110 to about 160° C. Adhesive curing and heat-setting is subsequently carried out at a temperature of about 150 to about 220° C., in alternative embodiments as described above.

The wrapped cord according to the invention finds utility in reinforcing rubber articles which comprise the treated wrapped cord according to the invention completely or partially embedded in rubber. Typical such cord-rubber composites are selected from the group consisting of tires, carcasses, belts and hoses. In one embodiment the wrapped cord according to the invention is used in tire side-walls and bead area, turn-up area of tire-carcasses in which high flex and compression fatigue resistance is required.

Typical rubbers into which the treated wrapped cord according to the invention is embedded are selected from those known in the art for reinforcements.

The following Examples are intended to demonstrate but not to limit the present invention. Unless otherwise stated, all percentages are in weight percent.

EXAMPLES

As the cord according to the present invention a 2200 dtex polyester core (D793, KoSa) and a 300 dtex shrinkable polyester as wrap from "Wire & Rapos" was used. Wraps per meter (WPM)=300.

RFL-Dip

The cord according to the present invention and the cord used for reference was treated with the following dip; after dilution with water (1 part dip A+9 parts water).

| | Dip A | | Dip B |
|---|---|---|---|
| VP-Latex (40%) | 416.7 | | 41.67 |
| RF-Resin (75%) | 39.9% | Dilution with 9 parts water ----------→ | 3.99 |
| Ammonia (25%) | 11.2 | | 1.12 |
| Formaldehyde (37%) | 12.4 | | 1.24 |
| Water | 519.8 | | 951.98 |
| | 1000.0 g | | 1000.0 g |

The solids content of the aqueous dip composition was 2.0 weight percent. This dip with approximately 2.0% solids content has been prepared from Dip-A by diluting it with water (1 part dip A+9 parts water=Dip B).

The dips were applied to the cords by spraying dip solution but other techniques are possible as well. For instance, the adhesive can also be applied in a bath-type application, resulting in the same effect.

All cords were dried and heat set after applying the adhesive dip. Wrap shrinkage occurred during drying process (120° C. for 5 min.), heat-set conditions 190° C. for 5 minutes. Wrap shrinkage occurs at both stages. The fatigue test using the Mallory tester was carried out as follows:

For 2200 dtex samples, 110 ends per decimeter (epdm) has been used. Tube bending angle: 75°.

Mallory Test Results

Range of Number of Cycles

| | |
|---|---|
| Reference twisted cord 1100 × 2.380/380 tpm, DPU: 5.0% Single cord (spool material) | 8.0–10.0 millions |

-continued

| | |
|---|---|
| Reference twisted cord<br>1100 × 2.380/380 tpm 2/5<br>DPU: 5.0<br>Tire cord fabric | 4.0–5.0 millions |
| Reference wrapped cord<br>2200 dtex, 300 WPM<br>DPU: 5.0% | 1.0–2.0 millions |
| Low DPU wrapped cord<br>2200 dtex, 300 WPM<br>DPU: 0.5% | 4.0–5.0 millions |

Polyester type is D793 from KoSa for all samples. Wrap: 300 dtex, high shrink polyester from Wire & Rapos.

What is claimed is:

1. A wrapped cord comprising a core bundle of organic filaments having a modulus of about 60 to about 500 cN/dtex and a wrap helically wound around said core bundle of filament in a spaced manner, wherein the wrap material has a free shrinkage at 100° C. being at least 10% higher than the free shrinkage of the core filaments.

2. The wrapped cord of claim 1, wherein the organic core filaments have a tensile strength of about 5.0 to about 15 cN/dtex.

3. The wrapped cord of claim 1, wherein the organic core filaments have a dtex of about 1.0 to about 10.0 dtex.

4. The wrapped cord of claim 1, wherein the core bundle of filaments comprises about 200 to about 2,000 filaments.

5. The wrapped cord of claim 1, wherein the organic core filaments are made of an organic material selected from the group consisting of aliphatic polyesters, aromatic polyesters and aliphatic polyamides.

6. The wrapped cord of claim 1, wherein the wrap comprises at least one filament.

7. The wrapped cord of claim 6, wherein the wrap has a dtex that is from 5 to 40% of the dtex of the organic core filaments dtex.

8. The wrapped cord of claim 1, wherein the wrap has a hot air shrinkage of about 10 to about 60% in hot air at 100° C.

9. The wrapped cord of claim 1, wherein the material of filaments of the wrap is selected from the group consisting of aliphatic polyesters, aromatic polyesters and aliphatic polyamides.

10. The wrapped cord of claim 9, wherein the polyester is selected from the group consisting of polyethylene terephthalate, polyethylene naphthalate, polyethylene bibenzoate, polytrimethylene terephthalate, polytrimethylene naphthalate, polytrimethylene bibenzoate, polybutylene terephthalate, polybutylene naphthalate and polybutylene bibenzoate or polyesters made from mixtures of the individual monomers.

11. The wrapped cord of claim 9, wherein the polyamide is selected from the group consisting of PA 6, PA 6.6 and PA 4.6.

12. The wrapped cord of claim 1, wherein the filaments of the wrap have the following further properties:

a modulus of about 20 to about 150 cN/dtex and a tenacity of about 2.0 to about 12.0 cN/dtex.

13. The wrapped cord according to claim 1, wherein the organic filaments are made of at least one polyester.

14. The wrapped cord according to claim 1 and comprising a core bundle of organic filaments and a low dtex, high shrinkage organic fiber wrap.

15. The wrapped cord according to claim 14, wherein the number of wrap turns per meter of core bundle is from about 100 to about 500 for a 2,200 dtex polyester core yarn.

16. The wrapped cord according to claim 15, wherein the number of wrap turns per meter of core bundle is from about 200 to about 400 for a 2,200 dtex polyester core yarn.

17. The wrapped cord according to claim 15, wherein the number of wrap turns per meter of core bundle is from 250 to 350 for a 2200 dtex polyester core yarn.

18. The wrapped cord of claim 5, wherein the organic core filaments are made of at least one polyester.

19. A wrapped cord comprising a core bundle of organic filaments having a modulus of abut 60 to about 500 cN/dtex and a wrap helically wound around said core bundle of filaments in a spaced manner, wherein the wrap material has a free shrinkage at 100° C. being at least 10% higher than the free shrinkage of the core filaments and shrunk by exposing the wrapped cord to an elevated temperature.

20. The wrapped cord of claim 19, wherein the organic core filaments have a tensile strength of about 5.0 to about 15 cN/dtex.

21. The wrapped cord of claim 19, wherein the organic core filaments have a dtex of about 1.0 to about 10.0 dtex.

22. The wrapped cord of claim 19, wherein the core bundle of filaments comprises about 200 to about 2,000 filaments.

23. The wrapped cord of claim 19, wherein the organic core filaments are made of an organic material selected from aliphatic polyesters, aromatic polyesters and aliphatic polyamides.

24. The wrapped cord of claim 19, wherein the wrap comprises at least one filament.

25. The wrapped cord of claim 21, wherein the wrap dtex is from 5 to 40% of the dtex the organic core bundle dtex.

26. The wrapped cord of claim 19, wherein the wrap filaments have a hot air shrinkage of about 10 to about 60% in hot air at 100° C.

27. The wrapped cord of claim 19, wherein the material of the wrap is selected from aliphatic polyesters, aromatic polyesters and aliphatic polyamides.

28. The wrapped cord of claim 27, wherein the polyester is selected from the group consisting of polyethylene terephthalate, polyethylene naphthalate, polyethylene bibenzoate, polytrimethylene terephthalate, polytrimethylene naphthalate, polytrimethylene bibenzoate, polybutylene terephthalate, polybutylene naphthalate and polybutylene bibenzoate or polyesters made from mixtures of the individual monomers.

29. The wrapped cord of claim 27, wherein the polyamide is selected from the group consisting of PA 6, PA 6.6 and PA 4.6.

30. The wrapped cord of claim 19, wherein the wrap material has filaments which have the following further properties:

a modulus of about 20 to about 150 cN/dtex and a tenacity of about 2.0 to about 12.0 cN/dtex.

31. The wrapped cord according to claim 19, wherein the core bundle comprises organic filaments and a wrap is helically wound around the bundle of organic filaments wherein the number of wrap turns per meter of core bundle is from about 100 to 500 for a 2200 dtex polyester core bundle.

32. The wrap according to claim 19, wherein the number of wrap times per meter of core bundle is from 200 to 400 for a 2200 dtex polyester core bundle.

33. The wrapped cord according to claim 19, wherein the number of wrap turns per meter of core bundle is from 250 to 350 for a 2200 dtex polyester core bundle.

34. The wrapped cord of claim 23, wherein the organic core filaments are made from at least one polyester.

* * * * *